US008840175B2

(12) United States Patent
Short

(10) Patent No.: US 8,840,175 B2
(45) Date of Patent: Sep. 23, 2014

(54) CONVERTIBLE MULTIFUNCTION OVERBED TABLE AND CHAIR

(71) Applicant: J. Gordon Short, Salt Lake City, UT (US)

(72) Inventor: J. Gordon Short, Salt Lake City, UT (US)

( * ) Notice: Subject to any disclaimer, the term of this patent is extended or adjusted under 35 U.S.C. 154(b) by 102 days.

(21) Appl. No.: 13/777,929

(22) Filed: Feb. 26, 2013

(65) Prior Publication Data

US 2014/0239680 A1 Aug. 28, 2014

(51) Int. Cl.

| | |
|---|---|
| ***A47B 85/00*** | (2006.01) |
| ***A47B 85/04*** | (2006.01) |
| ***A47B 83/02*** | (2006.01) |
| ***A47C 7/02*** | (2006.01) |

(52) U.S. Cl.

CPC .. *A47B 83/02* (2013.01); *A47C 7/02* (2013.01)
USPC ..... 297/124; 297/119; 297/122; 297/344.12; 297/325

(58) Field of Classification Search

USPC ..... 297/118, 119, 122, 124, 129, 337, 338, 297/344.12, 325
See application file for complete search history.

(56) References Cited

U.S. PATENT DOCUMENTS

| | | | | | |
|---|---|---|---|---|---|
| 4,240,663 | A * | 12/1980 | Locher | 297/239 |
| 5,026,118 | A * | 6/1991 | Vander Stel et al. | 297/338 |
| 5,669,658 | A * | 9/1997 | Liles | 297/123 |
| 5,816,655 | A * | 10/1998 | Hoegh | 297/338 |
| 5,829,826 | A * | 11/1998 | Ziccardi | 297/118 |
| 6,783,179 | B2 * | 8/2004 | Komura et al. | 297/344.12 |
| 7,025,415 | B1 * | 4/2006 | Wu | 297/119 |
| 7,318,622 | B2 * | 1/2008 | Rezag et al. | 297/118 |
| 7,716,759 | B2 * | 5/2010 | Wilder | 5/83.1 |
| 8,024,824 | B1 * | 9/2011 | Westermann | 5/85.1 |
| 8,720,989 | B2 * | 5/2014 | Jurcic et al. | 297/122 |
| 8,777,238 | B1 * | 7/2014 | Blackwood | 280/47.25 |
| 2003/0011228 | A1 * | 1/2003 | Komura et al. | 297/344.12 |
| 2005/0039256 | A1 * | 2/2005 | Price et al. | 5/86.1 |
| 2009/0200839 | A1 * | 8/2009 | Mildt et al. | 297/118 |
| 2011/0062751 | A1 * | 3/2011 | Andersson | 297/129 |
| 2012/0241234 | A1 * | 9/2012 | Wright | 180/65.51 |
| 2014/0196207 | A1 * | 7/2014 | Enriquez | 5/11 |

* cited by examiner

*Primary Examiner* — David R Dunn
*Assistant Examiner* — Richard Lowry
(74) *Attorney, Agent, or Firm* — J. Todd Rushton

(57) ABSTRACT

The present invention is a convertible multifunction overbed table and chair, or more specifically, the present invention is a medical furnishing that serves as an adjustable overbed table in a first configuration and a wheeled transport chair in a second configuration. The present invention may also serve as a medical staff work station, provide storage of patient records and medical charts, storage for the patient's personal effects, personal mirror, IV stand, catheter bag stand, secure storage for portable oxygen, and serve as a patient walker.

21 Claims, 9 Drawing Sheets

CONVERTIBLE MULTIFUNCTION OVERBED TABLE AND CHAIR

BACKGROUND

The present invention relates to a convertible multifunction overbed table and chair, more specifically, the present invention relates to a patient support apparatus, that may be used as an overbed table, provide storage for the patient's personal effects, provide organization of the patient's medical charts, securely store a supplemental oxygen bottle, provide an elevated platform for intravenous fluids, be used as a walker, be used as a straight chair and converted to a transport wheelchair.

The present application contains similar subject matter as registered U.S. Pat. No. 5,551,105, APPARATUS COMBINING OVERBED TABLE, IV STAND, WALKER AND SEAT, which is filed by the same applicant as the present application on Aug. 26, 1994. The disclosure therein incorporated by reference.

Floor space in patient facilities including, hospitals, rehabilitation centers, nursing homes and even home based convalescence, is always at a premium. Healthcare patients require a myriad of equipment for proper treatment and once all of the equipment is in place, there may be limited space for additional amenities, visitors, or even professional staff to conduct their duties. Also, due to the medical environment and the overall high cost of healthcare, medical equipment and furnishing are quite expensive. Hospitals typically cannot afford to purchase a complete set of equipment and furnishings for each patient bed or potential patient. While each bed will likely be equipped with an overbed table, it would be unusual to provide that same number of wheel chairs, walkers, or IV stands. Circumstances may arise where the need for furnishings may exceed the number available, or it may be inconvenient for the medical staff to leave a patient unattended to retrieve the desired furnishing. Additionally, many medical service providers require that admitted patients are transported by the staff while they are within the building, requiring that a wheelchair is located to transport a patient for x-rays, lab work or when being discharged from the facility.

What are needed are multipurpose medical furnishings that minimize room floor space usage and can be converted for more than one function in the medical environment.

SUMMARY OF THE INVENTION

The present invention is a convertible multifunction overbed table and chair, or more specifically, the present invention is a medical furnishing that serves as an adjustable overbed table in a first configuration and a wheeled transport chair in a second configuration. The present invention may also serve as a medical staff work station, provide storage of patient records and medical charts, storage for the patient's personal effects, personal mirror, IV stand, catheter bag stand, secure storage for portable oxygen, and serve as a patient walker.

A first embodiment of the present invention, or convertible multifunction overbed table and chair, has a wheeled base portion with upright supports and a rotatable L-shaped table/chair portion. The wheeled base has a low profile to extend under a patient's bed; a width somewhat wider than the table/chair portion and extends away from the upright supports to create a stable base for the device. The wheels are a caster arrangement that allows for easy multi-directional movement when the present invention is configured as an overbed table. The rear casters are locked into a rear facing rolling position when configured as wheeled chair.

When the device is configured as an overbed table, the overbed table includes a horizontal support surface that can accommodate a food tray and other patient personal care items. In one embodiment, the horizontal surface includes a raised edge to contain items that may be predisposed to roll on a flat surface and contain any spilled liquids. In another embodiment, the horizontal surface includes one or more cup holders or indentations to support and stabilize standard sized cups and drink containers. In yet other embodiments, the cup holders are configured for large sized containers, the cup holders are adjustable or the cup holders include a dampening or compressible material to securely hold cups or drink containers having various diameters.

One embodiment of the present invention includes a five-sided box at the proximal end of the horizontal support surface, or the end nearest to the upright supports. The box having a capacity for storage of the patient's regularly used personal effects, such as, writing materials, books or magazines, lotion, lip balm, toothbrush, snacks and the like. The bottom inside surface of the box is elevated above the horizontal support surface or table to prevent entry of spilled liquids into the box. This arrangement makes clean-up easier and minimizes damage to the patient's personal effects in the event of a spill. The top outside surface of the box forms a horizontal surface where medical staff can fill out patient charts, prepare medications, or setup IV fluid bags. The top surface may also include a raised edge to contain spills or prevent supplies from falling off.

Table height is adjustable to accommodate various bed heights and patient preferences. The height adjustment is accomplished by releasing a trigger mechanism that is accessible to a person standing opposite the extended table. In one embodiment, the table height is incrementally adjustable in one inch division from between 30 inches to 46 inches above the floor. In another embodiment of the present invention the table height is infinitely adjustable between a first height and a second height. In one embodiment of the present invention the table height adjustment is manual where the user must support and move the weight of the table from a first position to a second position. Another embodiment includes a counterbalance spring that aids both elevating and lowering the table height.

One embodiment of the present invention is convertible from a table to the wheel chair configuration by releasing the trigger mechanism and allowing the table portion to descend to the lowest position. The bottom position is indicated when the leading edge of the seat portion makes contact with the base portion. The user can then grasp the table at the cantilevered or distal end and rotate the table upward toward the vertical supports; the table will rotate approximately 100 degrees until proper alignment is achieved and the seat lowers into a secured position. The lowering of the seat also lowers direction lock mechanisms for the rear caster assemblies; the lock mechanisms may engage the rear casters directly upon lowering or when the wheeled chair is rolled forward and the casters are aligned into a parallel rear-facing configuration. The locked rear-facing caster configuration allows a person pushing the chair to steer effectively and maximizes the wheeled chair wheelbase, improving stability and overall safety. The rear casters may also include a rolling lock mechanism that is activated by the user's toe.

For one embodiment of the present invention, in order to change the device from the chair configuration to a table configuration, it is necessary to raise the chair to its top position using a handle that is built into the front of the patient storage compartment. When the chair structure encounters the top crossbar it will automatically begin to rotate to the table configuration and lock into a secure position once a horizontal orientation is achieved.

In one embodiment, the underside surface of the table forms the seat back and slopes backward approximately 10 degrees from an upright position. The seat bottom is configured to slope from front to back about 10 degrees. In other embodiments, the degree of incline for the seat back and bottom are set at different angles to improve user comfort. In yet other embodiments, the degree of incline for the seat back and bottom are adjustable.

In one embodiment of the present invention, the leading edge of the seat bottom is approximately 19 inches above the floor and 17 inches above foot rests incorporated into the top surface of the rolling support base. The seat width is limited to prevent overloading the device; a first embodiment, will not allow persons over approximately 250 pounds to use the device. It is contemplated that other embodiments of the present invention will have increased structural support, increased base and seat dimensions, allowing larger persons to use the device. The seat assembly is non-upholstered ergonomically contoured plastic that can be easily cleaned and disinfected. In another embodiment, the bulk of the components for the entire assembly may be fabricated using plastics and other materials having anti-bacterial properties. It is contemplated the larger components of present invention may be fabricated using methods such as rotary molding or laid up using a last or molds as required. Materials may be a plastic or composite material, such as, fiberglass, carbon fiber, Kevlar® or similar materials know or yet to be developed.

In another embodiment of the present invention, a hook is integrated into the leading edge of the seat near the center. It is anticipated that the hook may be used for a Foley catheter bag or for attaching personal items or other patient support devices.

In one embodiment of the present invention a space is provide in the support base between the footrest platforms. The space allows a patient to back up until the base of the seat touches the lower legs and allows the user to, comfortably and safely, lower into the chair. Proper alignment when preparing to be seated may also be accomplished by having the wheeled chair rolled into a position directly behind the patient and touching the patient's legs.

In yet another embodiment, a cross bar connects the upper ends of the vertical base support structure. The cross bar serves as a mechanical stop for the step back when configured as a wheeled chair. In one embodiment, one or more hooks are connected or formed integrally with the cross bar and may be used for attaching intravenous fluid containers.

In other embodiments of the present invention, a plurality of storage compartments are available. A first embodiment includes the five sided compartment described as patient personal storage near the proximal or supported end of the table. When the device of the present invention is configured as a table, the box is oriented in a horizontal position, however when the device is configured into a chair, the storage compartment is rotated, open side up, into a vertical orientation on the back of the seat with accessibility from behind the seat between the vertical support members. The direction of rotation insures that any items stored in the compartment are secure when changing device configurations. In another embodiment, additional storage is incorporated into the support base between the vertical support base uprights. This storage is in a vertical configuration and may be used to store personal effects, patient records or medical charts. In one embodiment this compartment includes an area contoured to securely hold a cylindrical oxygen bottle. In yet another embodiment, additional storage is provided in the support base below the table or seat in a horizontal configuration forming a basin or tray between the caster rails. This storage is larger and may be used during a patient's stay in the medical facility or may be used to transport the patient's personal effects or luggage from the facility to a vehicle.

In one embodiment, personal use mirrors are incorporated into the outside surface of the vertical support members, allowing the patient to perform basic personal hygiene and observe activity occurring behind them.

In another embodiment of the present invention, vertical handles are formed into, or attached to, the upright vertical support members. The handle may be used by medical staff or another person when moving the device or when transporting a patient in the wheeled chair configuration. The handles may also be used by a patient when using the device for support when standing or walking within the medical facility. It is contemplated that other embodiments of the present invention include a horizontal push or support handle.

In another embodiment, a dowel or pole is formed into the upper portion of at least one of the vertical support members allowing the user to mount an infusion pump or other medical devices having brackets configured to attach to the pole of a standard IV stand. In yet another embodiment accessory mounting or attachment holes are formed into the vertical support members.

In embodiment of the present invention, the table/chair portion may be separated from the support base structure by loosening set screws on each side of the vertical uprights of the base support structure, raising the table/chair portion to the highest position and sliding it forward away from the uprights. Disassembly may be beneficial for packaging, or during transport, storage or when cleaning.

BRIEF DESCRIPTION OF THE DRAWINGS

The following description of the embodiments can be understood in light of the Figures, which illustrate specific aspects of the embodiments and are part of the specification. Together with the following description, the Figures demonstrate and explain the principles of the embodiments. In the Figures the physical dimensions of the embodiment may be exaggerated for clarity. The same reference numerals in different drawings represent the same element, and thus their descriptions may be omitted.

DETAILED DESCRIPTION OF THE DRAWINGS

Figure 1:
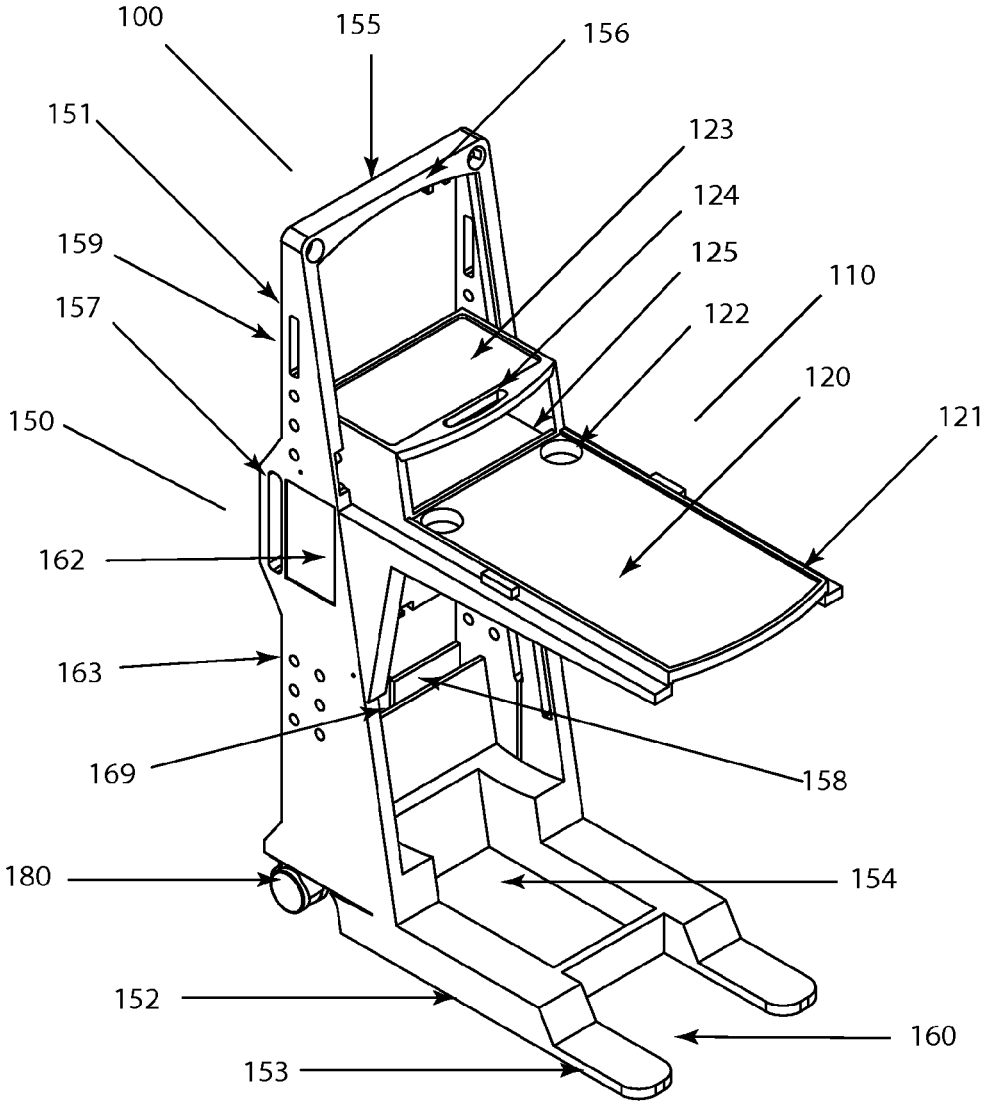
FIG. 1 is a perspective view of the present invention configured as an overbed table.

For the purposes of promoting an understanding of the principles in accordance with the disclosure, reference will be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure.

As used in this specification and the appended claims, the singular forms "a," "an," and "the" include plural referents unless the context clearly dictates otherwise. In describing and claiming the present disclosure, the following terminology will be used in accordance with definitions set out below. As used herein, the terms "comprising," "including," "containing," "characterized by," and the grammatical equivalents thereof are inclusive or open-ended terms that do not exclude additional, unrecited elements or method processes. A number used to represent a feature of the present invention may be repeated throughout the series of drawings and represents the same feature in each figure.

Shown in FIG. 1; a perspective view of the present invention or convertible multifunction overbed table and chair 100, configured as an overbed table, having a support base portion 150 and a table/chair portion 110. The support base portion 150 including vertical support members 151 and the caster base 152 designed to extend under the patient's bed. The caster base 152 including, integrated foot rests 153 separated by a clearance space 160 allowing the device 100, when configured as a chair, to be rolled up behind the patient or to allow the patient to move the chair by shuffling or moving their feet. The caster base 152 having, lockable rear casters 180 and front casters 181 (not shown). Caster base 152 also includes shallow storage bin 154 for the personal effects of the patient or for transporting larger items such a patient luggage. An additional storage compartment 158 is positioned between the vertical support members 151 near the base end, storage compartment 158 suited for storage of items such as medical records, charts or magazines. One embodiment of compartment 158 includes a contoured feature 169 formed to allow secure storage of a cylindrical oxygen bottle or similarly shaped objects. The upper end of the vertical support members 151 includes a cross bar or brace 155 which stabilizes the vertical support members 151 and may be used as a grab handle or to hang medical accessories on. As shown, cross bar 155 includes at least one hook 156 used for attaching an intravenous fluid bag or bottle. Push handles 157 are formed or attached to the back surface of the vertical support members 151, along with an accessory mounting pole or dowel 159. The outside surface of the vertical support members 151 includes a plurality of accessory mounting holes 163 and a personal hygiene mirror 162.

As shown in FIG. 1, the table/chair portion 110, when configured as a table, includes a horizontal member forming an overbed table 120 having a spill dam 121 formed around the outside perimeter, and at least one cup holder 122. A five sided storage compartment 125 is formed at the proximal or supported end of the overbed table 120. The outside top surface of the storage compartment 125 forming a horizontal surface or support staff work surface 123 that may be used by medical personnel to fill out charts, prepare medications or stage IV bags etc. Handle 124 is formed in the front edge of storage compartment 125; handle 124 is used when manipulating the table/chair portion 110 into the different configurations.

Figure 2:
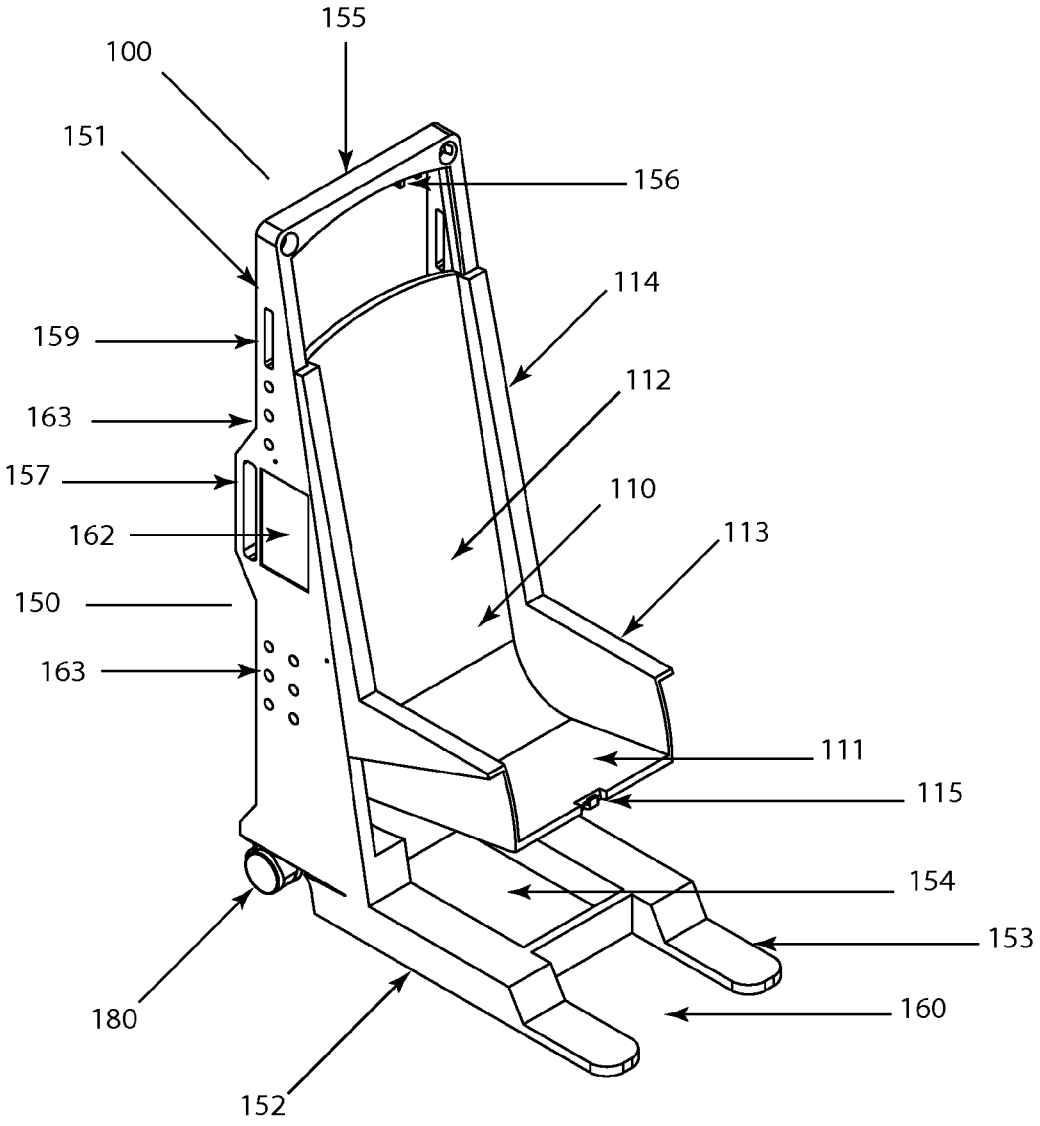
FIG. 2 is a perspective view of the present invention configured as a wheeled chair.

Shown in FIG. 2; a perspective view of the present invention or convertible multifunction overbed table and chair 100, configured as a wheeled chair, having a support base portion 150 and a table/chair portion 110. The support base 150 and table/chair portion 110 having the same components as described in FIG. 1, with FIG. 2 showing additional details of the table/chair portion including the seat 111, seat back 112, arm rest/side restraints 113, chair guide and protection rails 114 and catheter bag hook 115.

Figure 3:
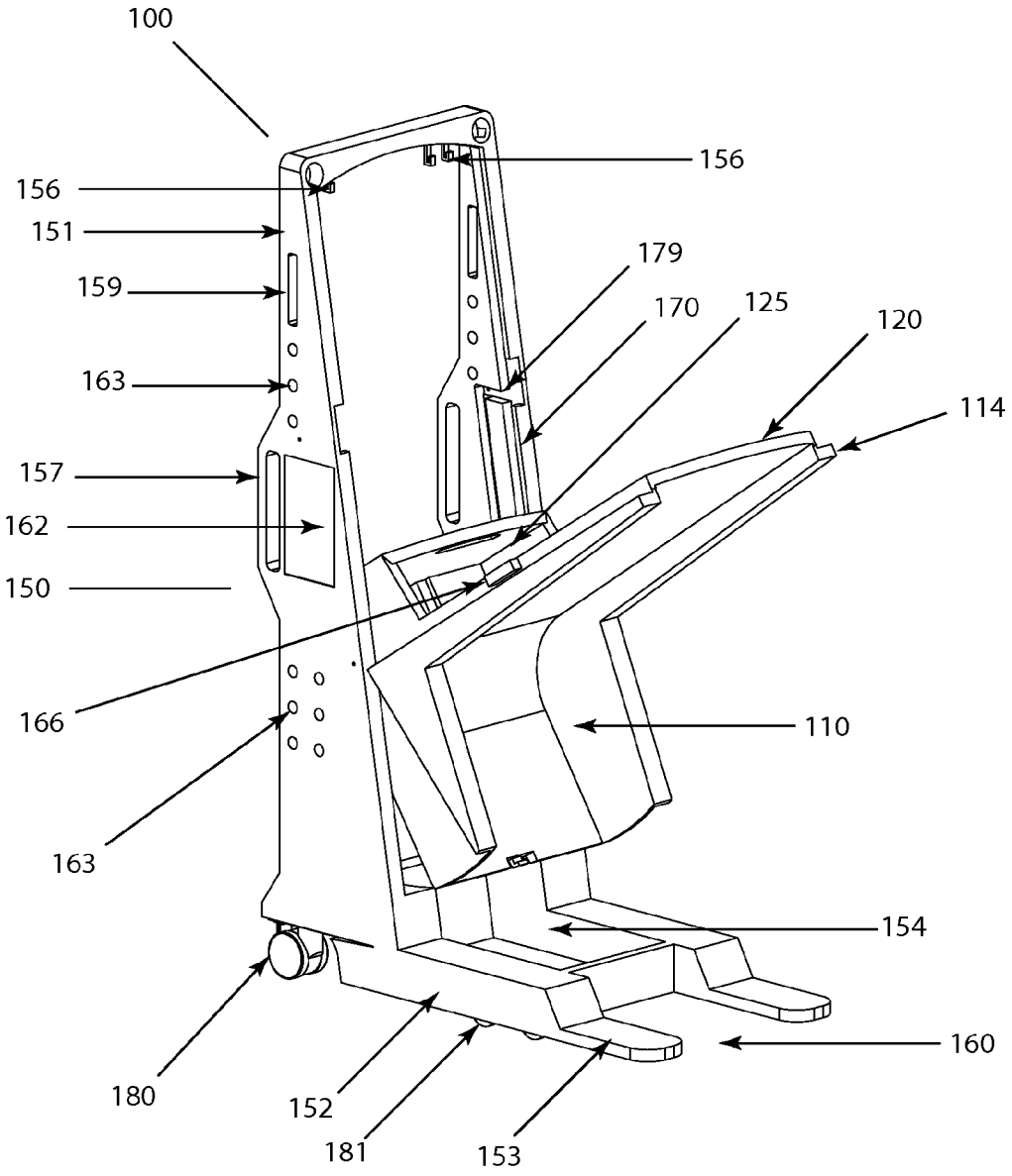
FIG. 3 is a perspective view of the present invention in conversion mode.

FIG. 3 is a perspective view of the present invention or convertible multifunction overbed table and chair 100, in transition between changing configurations between an overbed table and a wheeled chair. The transition configuration showing the additional features including, the upper portion of height adjustment and configuration rotation track 170, the seat lock boss opening 179, and the seat lock boss 166. The upper track seat lock boss 166 engages the height adjustment and configuration rotation track 170 when the table/chair portion 110 is configured as a chair, thus stabilizing the assembly. When the table/chair portion 110 is configured as a chair the seat lock boss 166 can rotated away from opening 179, when the table/chair portion 110 is pulled into the highest position. Seat lock boss 166 can be rotated into the opening 179 when the table/chair portion 110 is configured as a table and is dropped into its lowest position. Additionally, FIG. 3 shows how protection rails 114 overlap with the vertical support members 151, seat lock boss 166, and seat lock boss opening 179, protecting a user from the sliding junction and the height adjustment and configuration rotation track 170 engagement. One or more front casters 181 installed on each side at the distal end of the caster support base 152.

Figure 4:
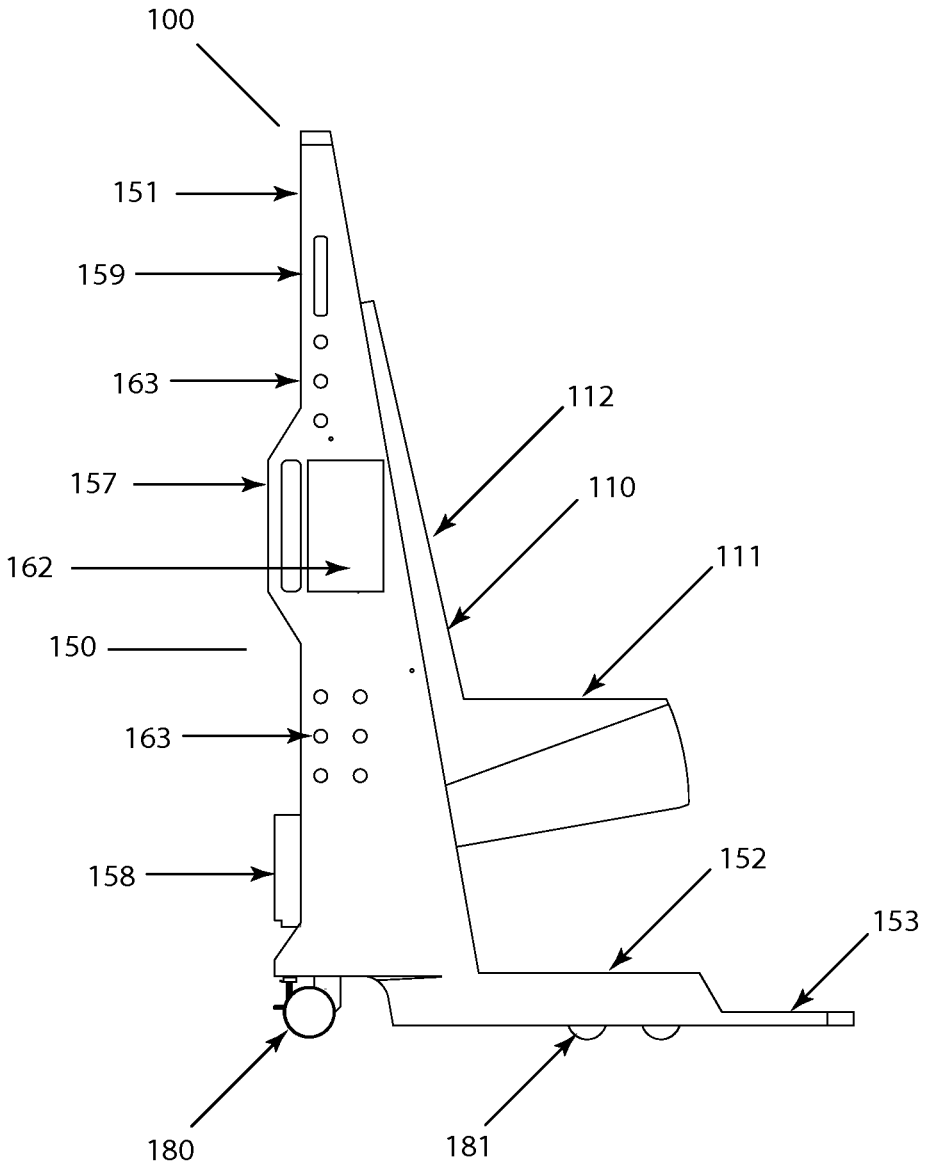
FIG. 4 is a side view of the present invention configured as a chair.

FIG. 4 illustrates a side view of the present invention or convertible multifunction overbed table and chair 100, configured as a chair with the seat portion 110 set at the lowest position and sloping backward approximately 10 degrees.

Figure 5A:
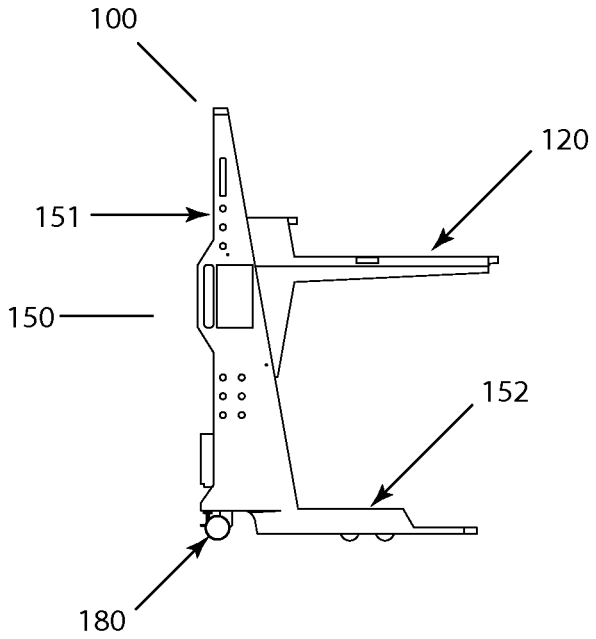
FIG. 5A is a side view of the present invention configured as an overbed table in an upper position.
Figure 5B:
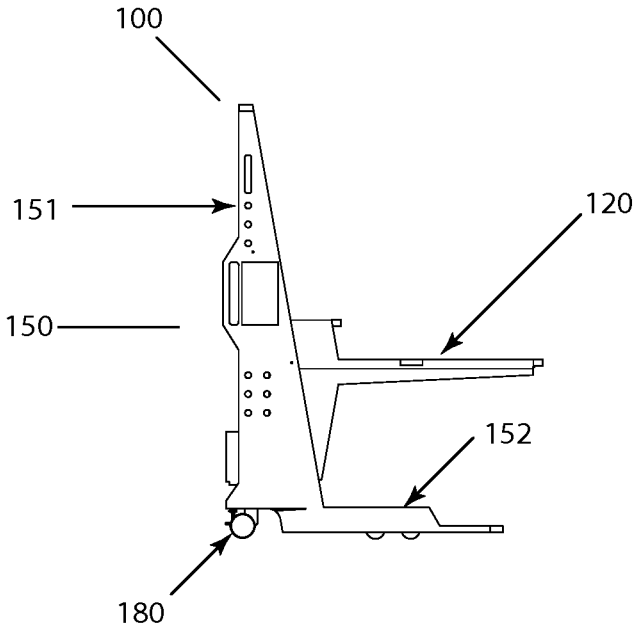
FIG. 5B is a side view of the present invention configured as an overbed table in the lowest position.

Illustrated in FIG. 5A is a side view of the present invention or convertible multifunction overbed table and chair 100 with the overbed table 120 set in the highest position. Shown in FIG. 5B is a side view of the present invention with the overbed table 120 shown in a lower position.

Figure 6:
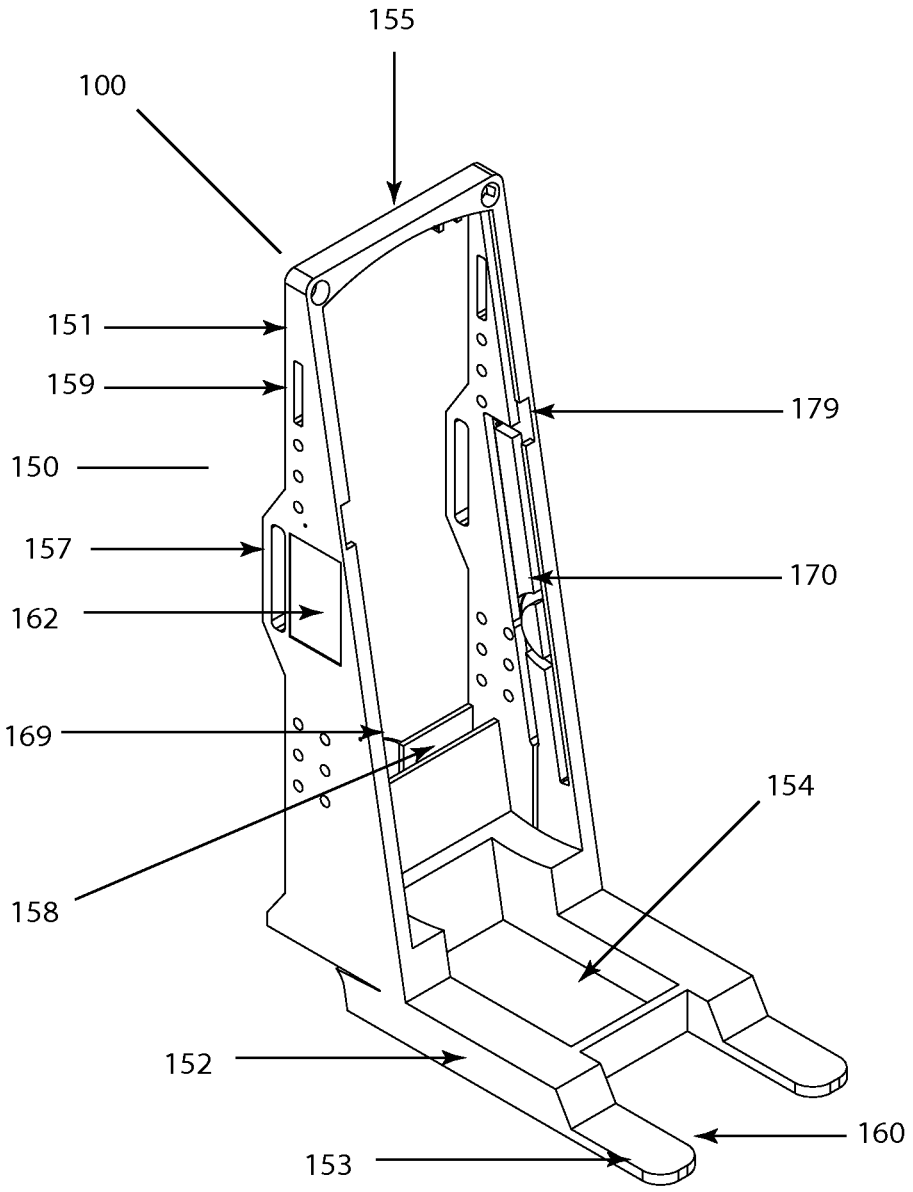
FIG. 6 is a perspective view the base portion of the present invention.

Illustrated in FIG. 6 is a perspective view of the rolling support base 150 with table/chair portion removed to provide additional clarity to the features.

Figure 7:
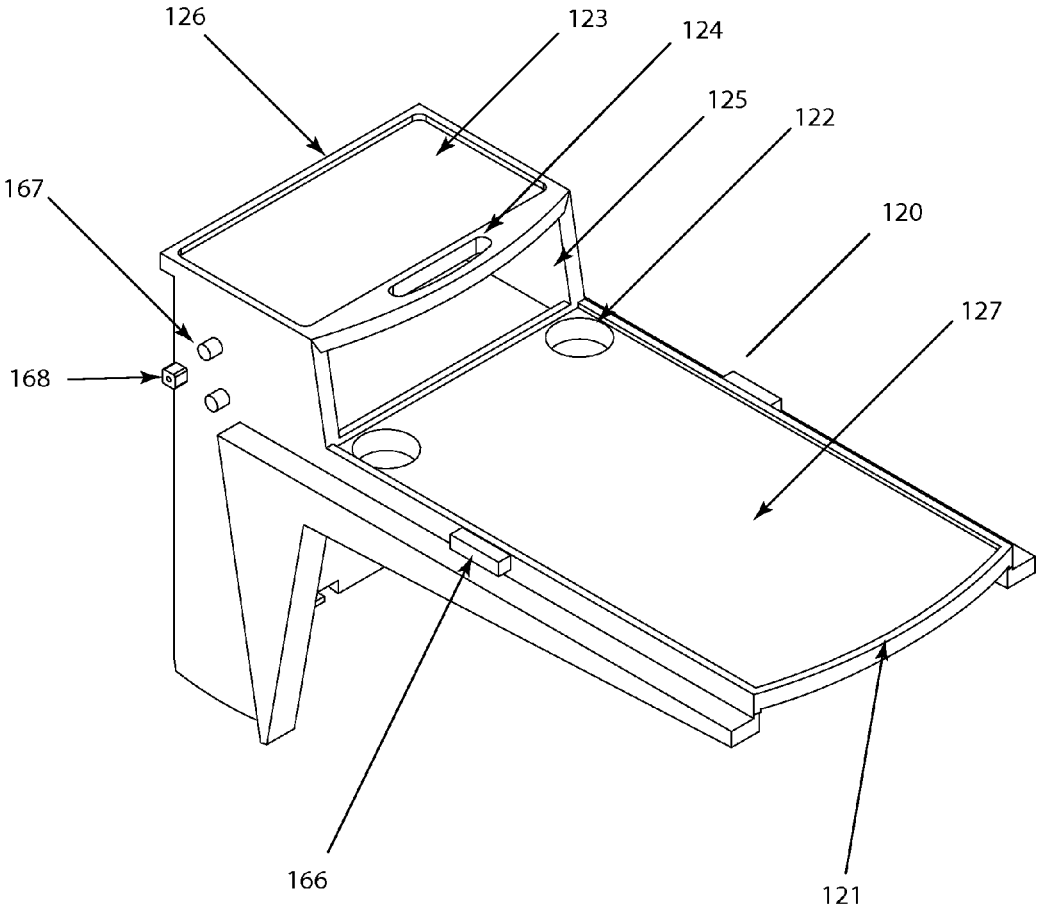
FIG. 7 is a perspective view the table/chair portion of the present invention.

FIG. 7 is a perspective view of the table/chair portion 110 removed from the support base 150. A set of pivot pins 167 and table height adjustment bosses 168 are formed on each side of the table/chair portion 110 at the proximal end. The pivot pins 167 and the table height adjustment boss 168 are designed to moveably engage in the height adjustment and configuration rotation track 170 formed on the inside surface of the vertical support members.

Figure 8A:
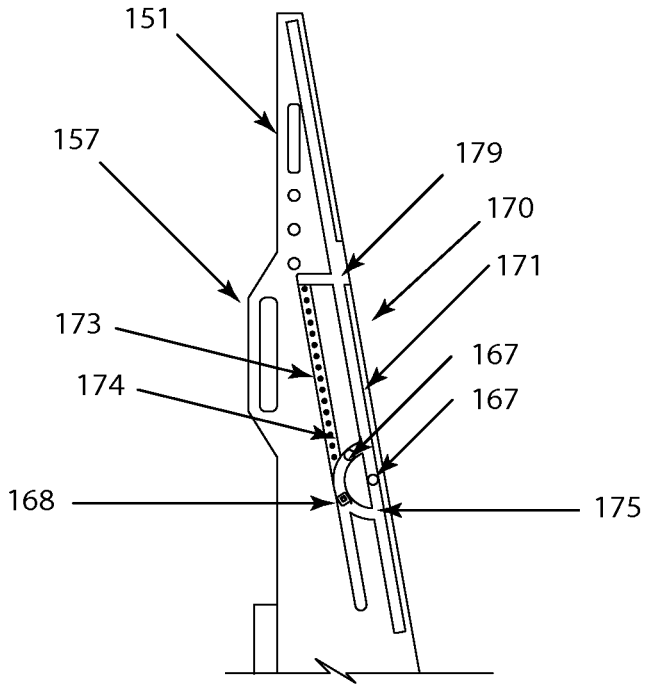
FIGS. 8A, 8B and 8C are details of the vertical support track and configuration transition area.
Figure 8B:
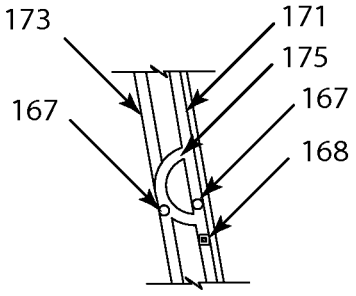
Figure 8C:
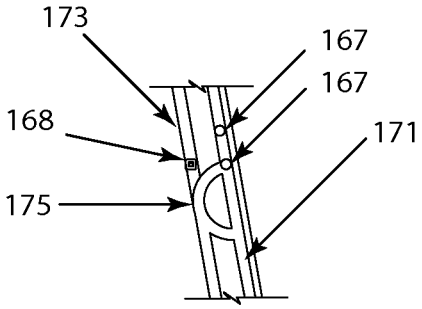

FIGS. 8A, 8B and 8C show details of the height adjustment and configuration rotation track 170, including, a seat lock boss opening 179, a height adjustment track 173 with a plurality of height adjustment holes 174, a pivot pin track 171 and a configuration rotation track 175. Pivot pins 167 ride in track 171, with table height adjustment boss 168 riding in the height adjustment track 173. In one embodiment, a lock pin (not shown) can be inserted through one of a plurality of holes 174 formed in the vertical support member 151 and into a single hole formed in the table height adjustment boss 168, allowing incremental adjustment of the overbed table 120 height. In other embodiments, the overbed height adjustment may be accomplished using a gear tooth track and a locking pawl assembly or may have a pressure or friction fit adjustment to secure the overbed table 120 at a certain height. FIG. 8A shows the pivot pins 167 and the table height adjustment boss 168 in the configuration rotation track 175 with table/chair assembly 110 in the process of reconfiguration. As shown in FIG. 8B pivot pins 167 and height adjustment boss 168 have been rotated to place the table/chair portion 110 in a chair configuration. While the pivot pins 167 and height adjustment boss 168 shown in FIG. 8C have the table/chair portion 110 in a table configuration.

Figure 9A:
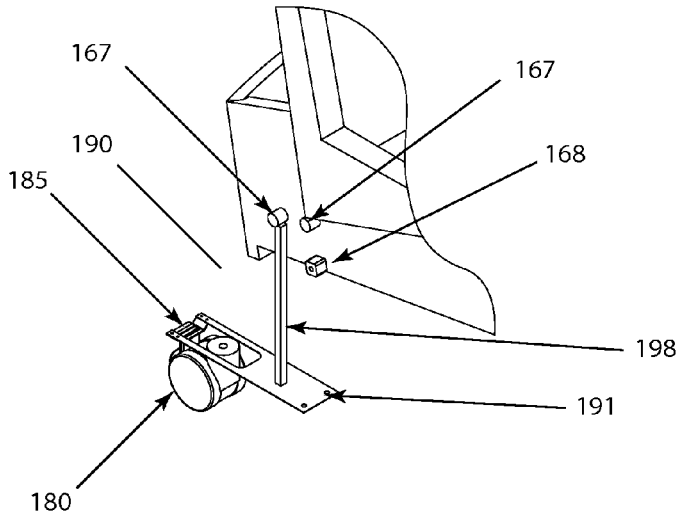
FIG. 9A is a perspective view of the caster directional lock mechanism.
Figure 9B:
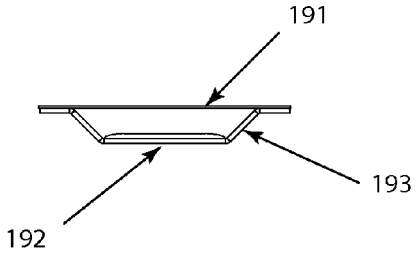
FIG. 9B is a front view of the caster directional lock mechanism, and, FIG. 9C is a perspective view of the caster directional lock plate.
Figure 9C:
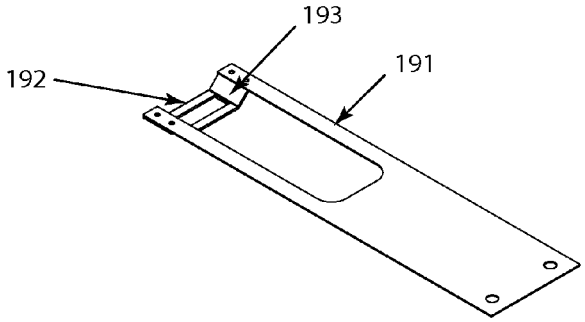

Illustrated in FIGS. 9A and 9B are perspective views of a rear caster locking plate assembly 190 which locks the rear caster 180 into a fixed rear-facing position by engaging the caster lock lever 185 with a lock plate 191. The locking plate assembly 190 is forced into place when the rear pivot pin 167 depresses actuator rod 198 when the table/chair portion 110 is configured as a wheeled chair and properly placed into the lowest position. The lock plate 191 is fabricated using a resilient material, such as spring steel, and includes a lock lever restriction surface 192 configured to engage the caster lock lever 185, if the caster is rear-facing when the chair portion 110 is lowered, the restriction surface 192 will engage the caster lock lever 185 directly. If the casters are misaligned when the chair portion 110 is lowered, the caster 180 will align rear-facing as soon as the wheeled chair assembly 100 is pushed forward. The caster lock lever 185 will ride up alignment ramps 193 until the lock lever 185 is secured on the restriction surface 192. The actuator rod 198 releases pressure on the lock plate when the table/chair portion 110 is reconfigured into an overbed table. FIG. 9C is an end view of the lock plate 191 showing alignment ramps 193 and restriction surface 192.

In view of the foregoing, those having ordinary skill in the relevant art will appreciate the advantages provided by the features of the present disclosure. It is to be understood that the above mentioned arrangements are only illustrative of the application of the principles of the present disclosure. Numerous modifications or alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. A convertible multifunction overbed table and chair comprising;

a rolling support base comprising, a base portion, and a vertical support portion, the base portion is substantially rectangular, configured to extend under a patient bed, having a height, a width and a length wherein to provide stability and not interfere with any portion of the patient bed, and a caster attached at each corner, the vertical support portion comprising, two vertical support columns, each vertical support column having a base end attached to the rolling base portion at a rear corner of the rolling base portion, each vertical support column having a substantially uniform thickness, the back surface of each vertical support column forming a line perpendicular to the rolling base portion, the base end of each support column having a width wider than the width of the free end forming a substantially uniform taper from the base end to the free end of the front surface of each vertical support column, a cross brace joining the free ends of the vertical support columns, the inside surface of each vertical support column parallel in relationship with the inside surface of the other vertical support column, a height adjustment rotation track formed on the inside surface of each vertical support column, the height adjustment rotation track comprising, a height adjustment track, a pivot pin track equidistant and parallel to the height adjustment track, and a semi-circular configuration rotation track intersecting with both the height adjustment track and the pivot pin track, the diameter of the configuration rotation track equal to the distance between the height adjustment track and the pivot pin track, a table/chair portion comprising, a substantially planer back surface, a front surface contoured in an "L" shape forming a seat having, a back support portion, and a seat portion, and side portions, the side portions having two pivot pins, and a height adjustment boss formed at the seat end of the side portion near the back surface of the table/chair portion, the two pivot pins and the height adjustment boss equidistantly spaced and configured to engage the height adjustment rotation track formed on the inside surface of the vertical support columns of the rolling support base, and, the table/chair portion configurable in two stable configurations, the first configuration wherein the back surface of the table chair portion is horizontal, forming a table, the table height adjustable within the length of the height adjustment track, the second configuration wherein the table/chair portion is rotated up approximately 100 degrees until the back surface of the table/chair portion is substantially parallel with the tapered front surface of the vertical support column of the rolling base portion, the contoured front surface of the table/chair portion forming a chair, the height adjustment boss rotating through the configuration rotation track from the height adjustment track to the pivot pin track and one pivot pin rotating through the configuration rotation track from the pivot pin track to the height adjustment track.

2. The convertible multifunction table and chair of claim 1 wherein the back surface of the table/chair portion includes, a raised top edge circumscribing the back surface and at least one cup holder recessed into the back surface.

3. The convertible multifunction table and chair of claim 1 wherein a five sided compartment is formed at the supported end of the back surface of the table/chair portion, the top outside surface of the compartment providing an elevated work surface, the inside bottom surface having an elevation higher than the back surface of the table/chair portion, and the open side facing away from the seat portion of the table/chair portion.

4. The convertible multifunction table and chair of claim 1 wherein the seat portion of the table/chair portion includes integrated arm rests and a hook on the front edge of the seat portion.

5. The convertible multifunction table and chair of claim 1 wherein the base portion of the rolling support base includes a recessed bin formed in the top surface.

6. The convertible multifunction table and chair of claim 1 wherein the base portion of the rolling support base includes footrests formed in the top surface and the material between the footrests removed to allow the user's feet to engage the floor.

7. The convertible multifunction table and chair of claim 1 wherein a rectangular five sided compartment is formed between the vertical support columns proximate the base portion, and the compartment open on the top side.

8. The convertible multifunction table and chair of claim 7 wherein the compartment includes a contoured portion to securely hold a cylindrical oxygen bottle.

9. The convertible multifunction table and chair of claim 1 wherein push handles are formed into the back surface of the vertical support columns.

10. The convertible multifunction table and chair of claim 1 wherein the cross brace joining the free ends of the vertical support columns includes at least one hook for suspending an intravenous fluid container.

11. The convertible multifunction table and chair of claim 1 wherein vertical support columns include a plurality of accessory attachment holes.

12. The convertible multifunction table and chair of claim 1 wherein vertical support columns include an integrated accessory mounting dowel.

13. The convertible multifunction table and chair of claim 1 wherein vertical support columns include a recessed personal mirror.

14. The convertible multifunction table and chair of claim 1 wherein a plurality of height adjustment holes are formed in the height adjustment track.

15. The convertible multifunction table and chair of claim 1 wherein the height of the table/chair portion is incrementally adjustable when the table/chair portion is configured as a table.

16. The convertible multifunction table and chair of claim 1 wherein the height of the table/portion is infinitely adjustable within a range of the height adjustment track.

17. The convertible multifunction table and chair of claim 1 wherein the casters proximate the vertical support columns are the rear casters and the rear casters include a rolling lock mechanism.

18. The convertible multifunction table and chair of claim 17 wherein the rear casters include a directional lock mechanism.

19. The convertible multifunction table and chair of claim 18 wherein the directional lock mechanism comprises;

an actuator rod that engages one of the pivot pins in the height adjustment track when the table/chair portion is configured as a chair, and, the actuator rod engaging a lock plate, having a lock lever restriction surface configured to engage a caster wheel lock lever when the caster is in a rear facing configuration preventing the caster from swiveling.

20. The convertible multifunction table and chair of claim 19 wherein the lock plate includes a lock lever guide ramp to guide the caster wheel lever onto the lock lever restriction surface when the caster is rolled into a rear facing configuration.

21. The convertible multifunction table and chair of claim 1 including a counter-balance spring engaging the table/chair portion.

* * * * *